United States Patent [19]

Sparacca et al.

[11] Patent Number: 4,854,084

[45] Date of Patent: Aug. 8, 1989

[54] EQUIPMENT FOR SANDING THE ROUNDED CORNERS OF BOARDS AUTOMATICALLY

[75] Inventors: Romano Sparacca, Pesaro; Gianfranco Caldari, Riccione, both of Italy

[73] Assignee: Technolegno S.R.L., Pesaro, Italy

[21] Appl. No.: 193,104

[22] Filed: May 12, 1988

[30] Foreign Application Priority Data

May 22, 1987 [IT] Italy ..... 3490 A/87

[51] Int. Cl.[4] ..... B24B 21/16

[52] U.S. Cl. ..... 51/139; 51/141; 51/147

[58] Field of Search ..... 51/137, 138, 139, 141, 51/142, 147

[56] References Cited

U.S. PATENT DOCUMENTS 2,320,639 6/1943 Morris ..... 51/139
2,901,870 9/1959 Zirbel ..... 51/137
3,159,949 12/1964 Heesemann ..... 51/147 X
3,624,965 12/1971 Gepfert ..... 51/138 X

FOREIGN PATENT DOCUMENTS 2145471 11/1979 Fed. Rep. of Germany ..... 51/141
64089 5/1977 Japan ..... 51/147

*Primary Examiner*—Robert P. Olszewski
*Attorney, Agent, or Firm*—Hoffmann & Baron

[57] ABSTRACT

In automatic equipment for sanding the rounded corners of boards, use is made of a sanding unit with an abrasive belt looped around at least two rollers and urged against the rounded corner of a board by a pressure pad positioned alongside one of the rollers; the system also makes use of a sensor which first ensures that the feed speed of the board and the traverse speed of the sanding unit are matched, and then triggers rotation of the entire unit about the rounded corner of the board.

2 Claims, 2 Drawing Sheets

1
50
2
24
6
3
17
15
23
20
21
19
9
15
18
19
9
13
22
12
10
25
2
8
17
24
15
23
26
3
6
7
5
4

EQUIPMENT FOR SANDING THE ROUNDED CORNERS OF BOARDS AUTOMATICALLY

BACKGROUND OF THE INVENTION

The invention relates to equipment for sanding the rounded corners of boards in automatic fashion. In furniture manufacture, widespread use is made of polygonal boards in wood or wood-related materials, mostly of square or rectangular shape, the corners of which are rounded off by machine with a suitable cutter and then given a smooth finish.

The current state of the art embraces no machine capable of effecting this final smoothing operation on the rounded corners of boards automatically, utilizing a sanding belt.

Disclosed herein is an arrangement which, in comparison to other prior art methods of different basic conception, offers the advantage of obtaining various degrees of surface roughness given by the characteristics of the abrasive belt material (type and size of grit); the abrasive can therefore be selected according to requirements, depending on whether the boards are unfinished, or have already been sprayed with paint or varnish, etc.

Accordingly, the object of the invention is to embody equipment that will stand the rounded corners of wood and composition boards automatically, using an abrasive belt.

One of the advantages afforded by the invention is that it becomes possible to finish the rounded corners of boards of any given width and thickness, using just the one item of equipment.

An additional advantage of the invention is that it is possible, likewise using the same equipment, to finish rounded corners of differing breadth and dissimilar radius.

SUMMARY OF THE INVENTION

The stated object is achieved with equipment according to the invention, in which use is made of a pivotably mounted belt sander unit; the abrasive belt is looped around a set of rollers, and urged against one rounded corner of the single board by the action of a pressure pad positioned alongside one of the rollers.

The equipment disclosed also comprises a sensor mechanism which first matches the feed speed of the board and the traverse speed of the sanding unit, and then triggers the movement whereby the sanding unit is swung bodily about the rounded corner of the board.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figures 1, 2:
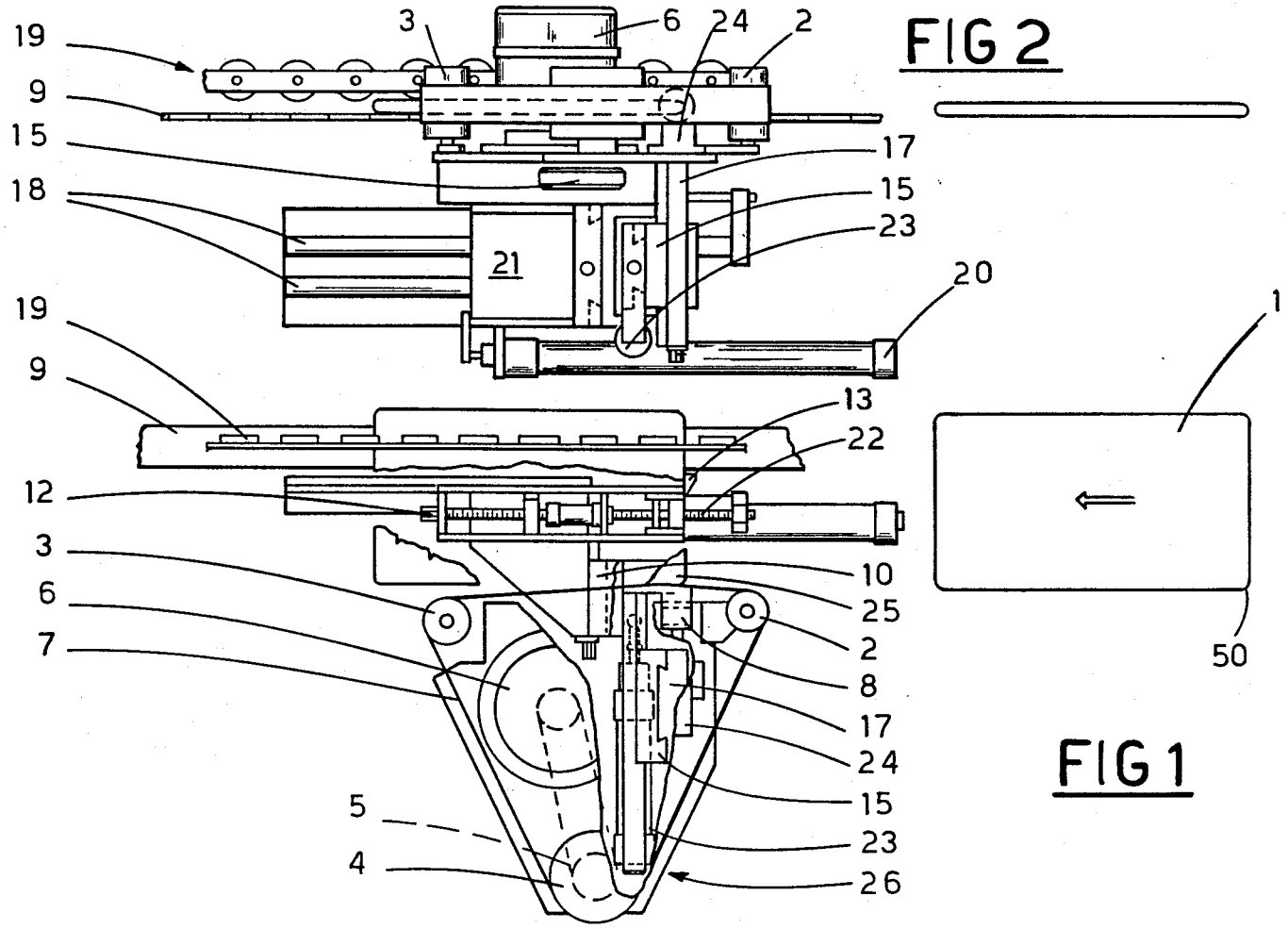
FIG. 1 shows a plan of equipment according to the invention, seen from above, occupying an initial position in the cycle whereby the rounded corner of a board is sanded.
FIG. 2 is a side elevation of the equipment of FIG. 1.
Figure 4:
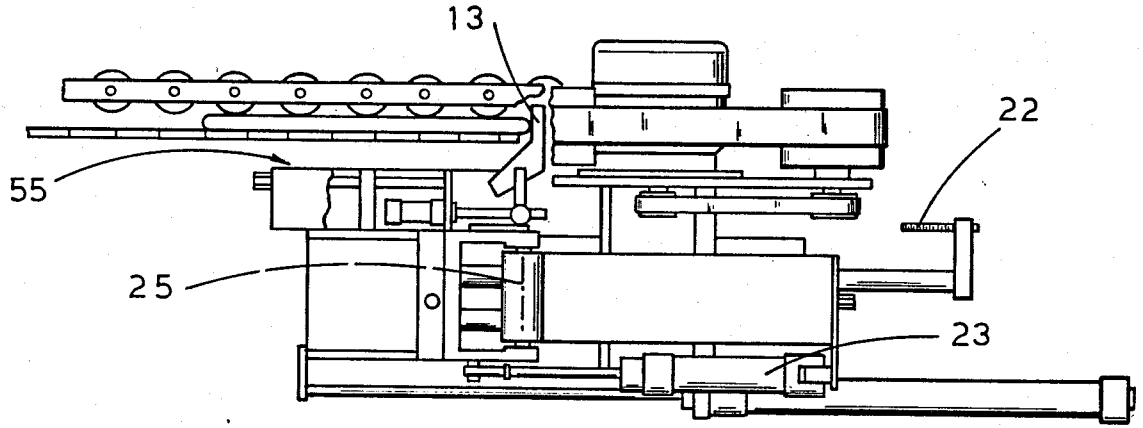
FIG. 4 is a side elevation of the equipment viewed in the position of FIG. 3.

In FIG. 1 of the drawings, 9 denotes a conveyor belt turning at a given speed, and serving to feed single boards through the equipment in continuous fashion; the board, denoted 1, is cantilevered sideways from the conveyor, but kept firmly associated with the transport surface by a suitable press 19.

26 denotes a sanding unit located to one side of the conveyor 9 and comprising three rollers 2, 3 and 4 the axes of which are disposed perpendicular to the plane occupied by the boards 1 and stationed at points corresponding substantially to the vertices of a triangle, in such a way that the rollers can tension a sanding belt 7 looped around them.

The first roller 2 revolves freely about its axis; the second roller 3, likewise freely revolving, can also oscillate in order to jockey and thus take up slack in the sanding belt 7. The third roller 4 is power driven by a belt 5 and an electric motor 6.

8 denotes a pressure pad, rigidly attached to the piston rod 51 of an actuator 24 stroking within a plane parallel with that occupied by the board 1, which is positioned near the first roller 2 in such a way that, when driven forward by the actuator 24, it will urge the running belt 7 against the board 1 and sand the area brought into contact, producing a smooth finish.

Figure 3:
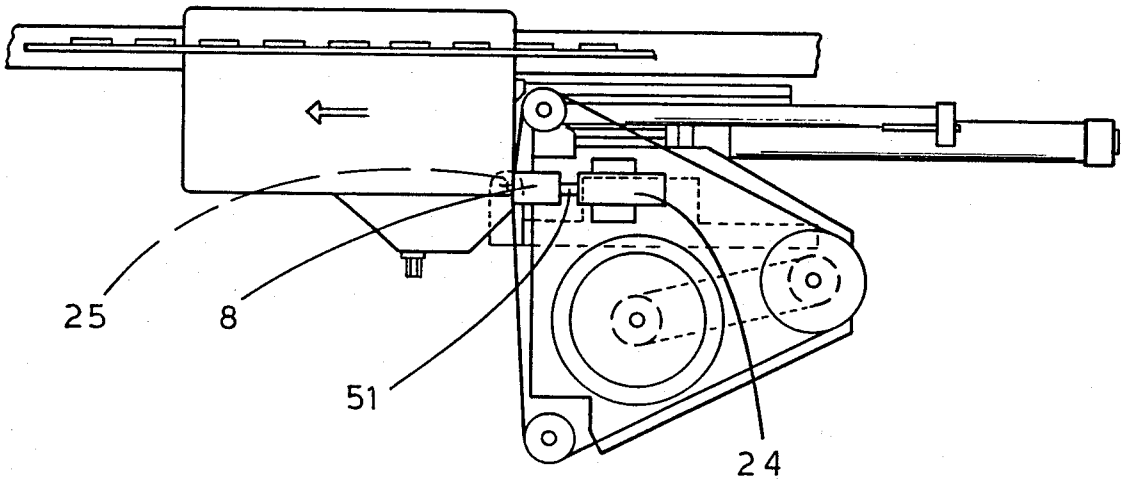
FIG. 3 is a second plan of the equipment, viewed in a final position of the sanding cycle.

The entire sanding unit 26 is mounted overhung to a slide 10 which enables its movement toward and away from the edge of the board 1; the slide is hinged about an axis, denoted 25, disposed perpendicular to the plane occupied by the board 1, such that the unit 26 can be supported and swung parallel with the board into a different position, for example as in FIG. 3, in which it is rotated through 90° from that of FIG. 1 and encroaches to a minimal degree on the transverse dimension of the board by virtue of the positioning of the pressure pad 8 in relation to the first roller 2. The unit is rotated in this fashion by an actuator 23 which strokes in a plane parallel to that occupied by the board 1, its line of action plotted in such a way as to avoid intersection with the hinge axis 25. In its turn, the slide 10 is supported by a carriage 21, mounted slidably on tracks 18 set parallel to the conveyor 9 and operated by a further acutator 20.

The embodiment of the mechanisms described above is such as to enable movement of the unit 26 in three directions; traversed as one with the carriage 21, parallel to the conveyor 9; transversed as one with the slide 10, at right angles to the conveyor 9; and rotated as one with the slide 10, pivoting about the hinge axis 25.

The unit 26 comprises two further slides 17 and 15, associated with one another and capable of movement in mutually normal directions. The first such slide, denoted 17, which provides movement perpendicular to the plane occupied by the board 1, serves to align and select the height of the sanding belt 7 and the pressure pad 8 in relation to the thickness of the board; the second slide 15 is used to adjust the relative positioning of the board 1 and the pressure pad 8 in such a way as will ensure that the finished rounded corner 50 exhibits a given radius.

The sanding unit 26 also comprises a device, denoted 55, serving to establish the position of the unit 26 itself in relation to the carriage 21, as considered in the feed direction of the conveyor 9. Such a positioning device 55 incorporates a catch 13 capable of alternating between an at-rest position, below the level of the plane occupied by the single boards 1 on the conveyor 9, and a position in which it is brought to bear against the trailing edge of the board 1 currently held on the conveyor surface. The catch 13 also serves as a speed sensing medium, as will appear from the following description of the equipment's operating cycle.

The position of the sanding unit 26 relative to the carriage 21 is adjusted by turning a lead screw 12; the screw is associated with the catch 13, and permits of moving it back along the feed path of the conveyor 9 in order to retard its position from that of the axis of the pressure pad 8 by a distance equal to the radius of the rounded corner 50.

Operation of the equipment occurs substantially according to the following cycle:

single boards 1 are fed in and carried forward by the conveyor 9, cantilevered toward the sanding unit and held stably in position by the press 19;

moving forward, the single board 1 will trigger operation of the carriage actuator 20, causing the carriage 21 itself to traverse in the same direction as that of the conveyor 9, though at higher speed;

the catch 13, normally retained below the level of the conveyor 9 by a stop 22, is now released by the forward movement of the carriage 21 and rises from its at-rest position to locate against the trailing edge of the board 1 about to be sanded;

with progress of the carriage 21 and of the board 1 united mechanically by contact through the catch 13, the speeds of the carriage 21 and the conveyor 9 are matched, and further progress automatically triggers operation of the remaining two actuators 24 and 23; (It will be observed at this point that, from the mechanical standpoint, the catch 13 functions as a sensing medium that serves to match the feed speed of the board 1 and the longitudinal traverse speed of the sanding unit 26);

the first actuator 24 now urges the pressure pad 8 against the running abrasive belt 7, causing it to assume the appropriate profile and hug the board 1, whilst the second actuator 23 causes the unit 26 to pivot bodily through 90° about its hinge axis 25 and thus sand the rounded corner in its entirety;

following a brief pause, the cycle of movements mentioned will be repeated in reverse order so as to return the equipment to its initial configuration, ready for the next board.

Embodied as described above and illustrated, the equipment will of course finish only the rear corner 50 of the board nearest to the sanding unit 26; reversing the configuration of the unit left to right, however, the front nearside corner can be sanded in simliar fashion. In this instance, it is preferable to reverse the position of the catch 13 as well, so as to check the leading edge of the board rather than follow the trailing edge.

Whilst the above description assumes inclusion of the equipment together with other power machinery in an existing line for shaping and finishing boards of the kind in question, the same advantages would be afforded, and no substantial modification would be required, were it to be operated as a stand-alone unit with or without the conveyor 9.

What is claimed:

1. Equipment for sanding the rounded corners of boards automatically, utilizing a feeder band to feed overhanging boards along a first direction and at a predetermined feed speed, and a sanding unit that comprises:

a carriage, mounted slidably along a parallel trajectory to said first direction;

an actuator operatively coupled to said carriage for moving said carriage at a regulated traverse speed in a parallel trajectory to the first direction;

a first slide supported by said carriage, which enables transverse movements of the sanding unit toward and away from the edge of each board:

at least two rollers, one of which is power driven;

an abrasive belt looped around said rollers;

a pressure pad situated to contact the abrasive belt and to urge the abrasive belt against the rounded corner of a board during the sanding operation, said pad being located close to one of the two rollers in such a way that the sanding unit can pivot bodily about the rounded corner; and sensing means for matching the predetermined feed speed of the boards and the traverse speed of the carriage and sanding unit, and thereupon to enable said traverse movements and pivoting movements of the sanding unit about the rounded corner of the board.

2. Equipment as in claim 1, which further comprises a second slide, the sanding unit being mounted to the second slide so that the sanding unit can be traversed in a direction perpendicular to the plane occupied by the board for the purpose of correcting the alignment of the abrasive belt and the pressure pad to suit boards of different thickness.

* * * * *